US008460055B2

(12) United States Patent
Cheng

(10) Patent No.: US 8,460,055 B2
(45) Date of Patent: Jun. 11, 2013

(54) THREE-DIMENSIONAL HEART POSITION SUPPORT FRAME FOR LOW-HEART UNDERWEAR

(75) Inventor: Pik Ho Liza Cheng, Kwai Chung (HK)

(73) Assignee: Embry (China) Garments Ltd., Shenzhen (CN)

( * ) Notice: Subject to any disclaimer, the term of this patent is extended or adjusted under 35 U.S.C. 154(b) by 286 days.

(21) Appl. No.: 12/896,303

(22) Filed: Oct. 1, 2010

(65) Prior Publication Data

US 2011/0124268 A1 May 26, 2011

(30) Foreign Application Priority Data

Nov. 20, 2009 (CN) ..... 2009 1 0109808

(51) Int. Cl.
*A41C 3/00* (2006.01)

(52) U.S. Cl.
USPC ..... 450/41; 450/45; 450/48

(58) Field of Classification Search
USPC ..... 450/41, 45, 48; 2/255, 259, 262, 2/264
See application file for complete search history.

(56) References Cited

U.S. PATENT DOCUMENTS

| | | | | |
|---|---|---|---|---|
| 2,463,319 | A * | 3/1949 | Schwartz | 450/45 |
| 2,480,049 | A * | 8/1949 | Rosenberg | 450/45 |
| 2,483,272 | A * | 9/1949 | Gluckin | 450/48 |
| 2,691,168 | A | 12/1954 | Roth | |
| 2,731,640 | A * | 1/1956 | Garson | 450/45 |
| 2,769,180 | A * | 11/1956 | Tareau et al. | 450/45 |
| 2,844,157 | A * | 7/1958 | Griffith | 137/82 |
| 2,923,300 | A * | 2/1960 | Ots | 450/45 |
| 2,926,668 | A * | 3/1960 | Schaumer | 450/41 |
| 2,954,031 | A * | 9/1960 | Froehlich | 450/48 |
| 5,527,202 | A * | 6/1996 | Morgan et al. | 450/48 |
| 6,019,662 | A * | 2/2000 | Fildan | 450/41 |
| 6,203,400 | B1 * | 3/2001 | Allen et al. | 450/41 |

FOREIGN PATENT DOCUMENTS

| | | |
|---|---|---|
| FR | 958 392 A | 3/1950 |
| FR | 1 302 547 A | 8/1962 |
| GB | 2 411 573 A | 9/2005 |

* cited by examiner

*Primary Examiner* — Gloria Hale
(74) *Attorney, Agent, or Firm* — Merchant & Gould P.C.

(57) ABSTRACT

A three-dimensional support frame for the linkage section (also known as "heart") of bra cups for low-heart underwear is disclosed. The support frame comprises a body having a U-shaped support frame. The body of the support frame is made of a wide flat wire; wire surfaces of two vertical portions of the body of the support frame being correspondingly twisted outwardly at an angle with respect to a vertical axis, forming an anticlockwise angle of 15°-85° with respect to a vertical plane, and the twists starts at a position of the maximum radius of semicircular lower portion of the U shape. The twisted wire surfaces of the two vertical portions are of an arc-shaped structure which is curved outwardly, an outwardly curved portion with a maximum curvature being offset in a distance of 5 mm-50 mm with respect to midpoint of a bottom portion of the U-shaped support frame.

10 Claims, 4 Drawing Sheets

THREE-DIMENSIONAL HEART POSITION SUPPORT FRAME FOR LOW-HEART UNDERWEAR

This application claims benefit of Ser. No. 200910109808.2, filed 20 Nov. 2009 in China and which application is incorporated herein by reference. To the extent appropriate, a claim of priority is made to each of the above disclosed applications.

TECHNICAL FIELD

The invention relates to a three-dimensional heart position support frame for low-heart underwear, belonging to an assistance accessory of garments, in particular, to cup support components of such underwear as a brassiere, a bodice and so on.

BACKGROUND ART

At present, underwear can be worn to effectively brace and support breasts and better outline a contour shape of the breasts by providing support components in cups and also by designing a low-heart underwear and brassiere capable of clearly presenting the shape of a cleavage portion. Such low-heart underwear or brassiere needs to be provided with a bracket capable of outlining a cleavage at the heart position, wherein, in the prior art, a semicircular support loop is arranged in two cups, which not only limits heart position but also fails to coordinate outerwear accentuate cleavage line of women very well.

SUMMARY OF THE INVENTION

The objective of the invention is to provide a three-dimensional heart position support frame for low-heart underwear that can bring about distinct support effect, show a three-dimensional breast shape at any time, is comfortable to wear and coordinate any outerwear without adversely influencing aesthetics,.

The objective of the invention is achieved by means of the following:

A three-dimensional heart position support frame for low-heart underwear, a body of the support frame being a U-shaped support frame, and blank of the body of the support frame being structured as a wide flat wire; wire surfaces of two vertical portions of the body of the support frame being correspondingly twisted outwardly at an angle with respect to a vertical axis, forming an anticlockwise angle of 15°-85° with respect to a vertical plane, the twist starting at a position of the maximum radius of semicircular lower portion of the U shape, wherein the twisted wire surfaces of the two vertical portions are of an arc-shaped structure which is curved outwardly, an outwardly curved portion with a maximum curvature being offset in a distance of 5 mm-50 mm with respect to midpoint of a bottom portion of the U-shaped support frame.

The twisted wire surfaces of the two vertical portions are of an arc-shaped structure which is curved outwardly, the outwardly curved portion with a maximum curvature thereof being offset in a distance of 5 mm with respect to the midpoint of the bottom portion of the U-shaped support frame; the wire surfaces of the two vertical portions are at an anticlockwise angle of 15° with respect to the vertical plane.

The twisted wire surfaces of the two vertical portions are of an arc-shaped structure which is curved outwardly, the outwardly curved portion with a maximum curvature thereof being offset in a distance of 20 mm with respect to the midpoint of the bottom portion of the U-shaped support frame; the wire surfaces of the two vertical portions are at an anticlockwise angle of 30° with respect to the vertical plane.

The twisted wire surfaces of the two vertical portions are of an arc-shaped structure which is curved outwardly, the outwardly curved portion with a maximum curvature thereof being offset in a distance of 40 mm with respect to the midpoint of the bottom portion of the U-shaped support frame; the wire surfaces of the two vertical portions are at an anticlockwise angle of 60° with respect to the vertical plane.

The twisted wire surfaces of the two vertical portions are of an arc-shaped structure which is curved outwardly, the outwardly curved portion with a maximum curvature thereof being offset in a distance of 50 mm with respect to the midpoint of the bottom portion of the U-shaped support frame; the wire surfaces of the two vertical portions are at an anticlockwise angle of 85° with respect to the vertical plane.

The wide flat wire forming the body of the support frame is of a stainless steel material.

The wide flat wire forming the body of the support frame is a wire of polyester plastic or a wire of resin plastic.

The wide flat wire forming the body of the support frame is a silica gel wire or a nylon wire.

The wide flat wire has a cross section of an ellipse.

The wide flat wire has a cross section of a trapezoid.

The invention is of a simple structure, and when the invention is inserted into a heart position of a low-heart brassiere or underwear, the wire surfaces of the two vertical portions can fit cups in shape and closely contact profiles of breasts at cleavage position to bring about excellent bracing effect, and can adjust heart position level according to different style designs to outline a three-dimensional shape at the cleavage position; in other words, the invention not only produces aesthetic wearing effect of low-heart underwear but also ensures wear comfort.

DESCRIPTION OF SPECIFIC EMBODIMENTS

A detailed description of specific embodiments of the present invention is given below with reference to the above drawings:

The first embodiment is shown in FIGS. 1, 2, 3, 4, 5, 6 and 7.

For achieving the objective of the invention, a body of the support frame 1 is a U-shaped support frame, and blank structure of the body of the support frame 1 is a flat wire; the body of the support frame is a U-shaped support frame, and blank structure of the body of the support frame is a flat wire; wire surfaces 2, 3 of two vertical portions of the body of the support frame are correspondingly twisted outwardly at an angle with respect to a vertical axis, forming an anticlockwise angle of 15°-85° with a vertical plane. The twist starts from a position of the maximum radius f of semicircular lower portion of the U shape. The wire surfaces 2, 3 of the two vertical portions are of an arc-shaped structure which is curved outwardly, the outwardly curved portion with a maximum curvature being offset in a distance of 5 mm-50 mm with respect to midpoint of the bottom portion of the U-shaped support frame. In this embodiment, the outwardly curved portion with a maximum curvature, in an outwardly curved arc shape, of the twisted wire surfaces 2, 3 of the two vertical portions is offset in a distance H of 5 mm with respect to midpoint of the bottom portion of the U-shaped support frame.

Figure 1:
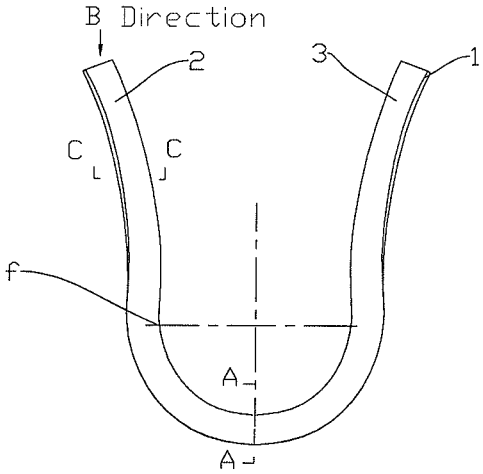
FIG. 1 is a plan schematic structural view of the invention.
Figure 2:
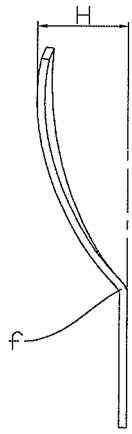
FIG. 2 is a right side view of the invention in FIG. 1.
Figure 3:
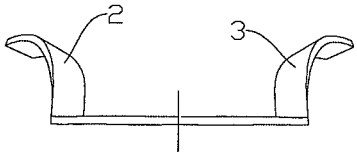
FIG. 3 is a top view of FIG. 1 of the invention.
Figure 4:
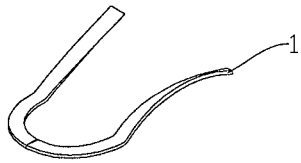
FIG. 4 is a three-dimensional schematic structural view of the invention in FIG. 1.
Figure 5:
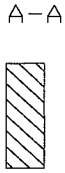
FIG. 5 is an A-A sectional view in accordance with the invention in FIG. 1.
Figure 6:
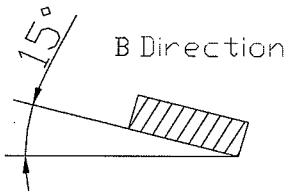
FIG. 6 is a schematic view of twisting angle of an end surface in a B direction in FIG. 1 of the invention.
Figure 7:
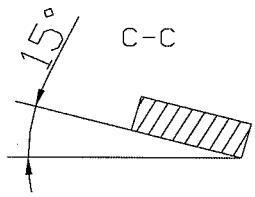
FIG. 7 is a schematic view of twisting angle of a C-C sectional portion in FIG. 1 of the invention.
Figure 8:
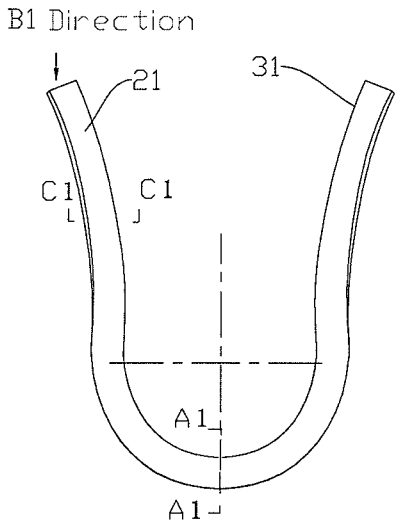
FIG. 8 is a schematic structural view of the second embodiment of the invention.
Figure 9:
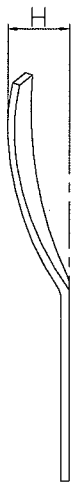
FIG. 9 is a right side view of the invention in FIG. 8.
Figure 10:
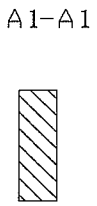
FIG. 10 is an A1-A1 sectional view of FIG. 8 of the invention.
Figure 11:
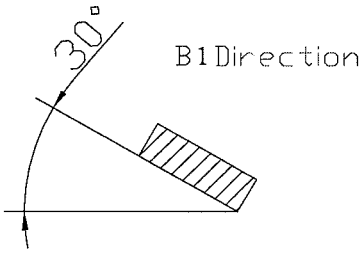
FIG. 11 is a schematic view of twisting angle of an end surface in B1 direction in FIG. 8 of the invention.
Figure 12:
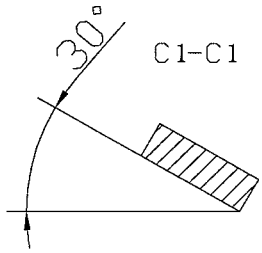
FIG. 12 is a schematic view of twisting angle of a C1-C1 sectional portion in FIG. 8 of the invention.
Figure 13:
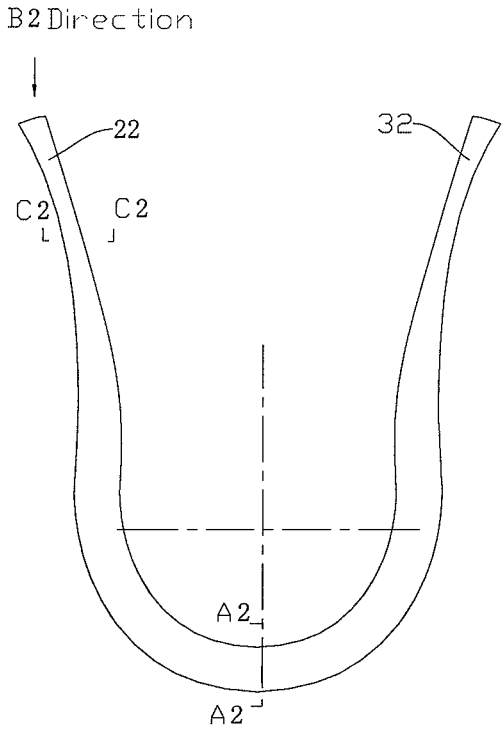
FIG. 13 is a schematic structural view of third embodiment of the invention.
Figure 14:
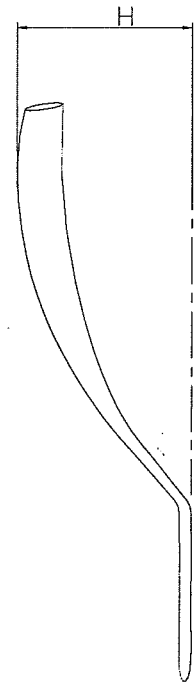
FIG. 14 is a right side view of the invention in FIG. 13.
Figure 15:
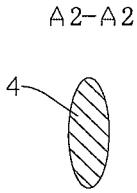
FIG. 15 is an A2-A2 sectional view of FIG. 13 of the invention.
Figure 16:
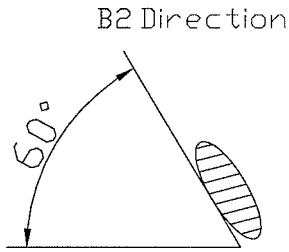
FIG. 16 is a schematic view of twisting angle of an end surface in a B2 direction in FIG. 13 of the invention.
Figure 17:
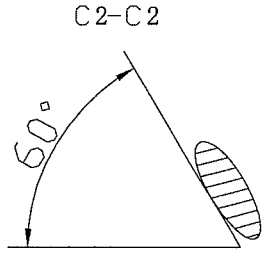
FIG. 17 is a schematic view of twisting angle of a C2-C2 sectional portion in FIG. 13 of the invention.
Figure 18:
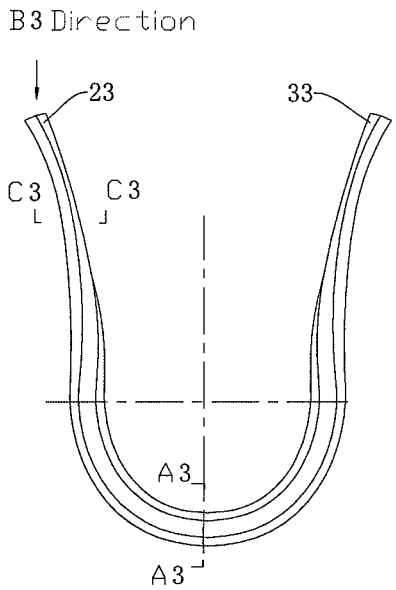
FIG. 18 is a schematic structural view of fourth embodiment of the invention.
Figure 19:
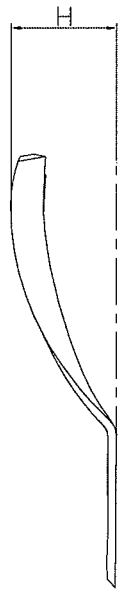
FIG. 19 is a right side view of the invention in FIG. 18.
Figure 20:
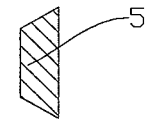
FIG. 20 is an A3-A3 sectional view of FIG. 18 of the invention.
Figure 21:
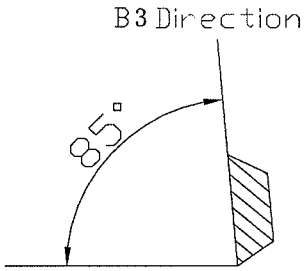
FIG. 21 is a schematic view of twisting angle of an end surface in a B3 direction in FIG. 18 of the invention.
Figure 22:
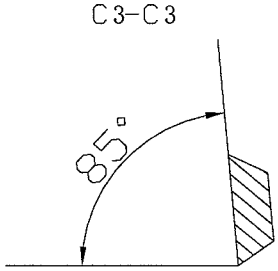
FIG. 22 is a schematic view of twisting angle of a C3-C3 sectional portion in FIG. 18 of the invention.

In this embodiment, as shown in FIGS. 2, 5, 6 and 7, the wire surfaces 2, 3 of two vertical portions are correspondingly twisted outwardly at an angle with respect to a vertical axis and are in an arc-shaped structure which is curved outwardly, and, as shown in the A-A sectional view at the lowest point of the semicircle of the U shape, a plane of the wide flat wire is vertical in the A-A sectional view. With regard to the wires surface of its vertical portions, as seen in the B direction, the end surface of the wire surface 2 is at an angle of 15° with respect to the vertical plane. Moreover, since the wire surfaces of two vertical portions of the body of the support frame are correspondingly twisted outwardly at an angle with respect to a vertical axis, as can be seen from FIG. 7, the wire surface of the vertical portion as shown in the C-C sectional position is at an anticlockwise angle of 15° with respect to the vertical plane. FIG. 2 shows that the wire surfaces 2, 3 of the two vertical portions are in an arc shape structure which is curved outwardly, the outwardly curved portion with a maximum curvature of which is offset in a distance H of 5 mm with respect to midpoint of the bottom portion of the U-shaped support frame.

The support frame in such structure is of a nice smoothness and is comfortable to wear. The wide flat wire forming the body of the support frame described in this embodiment is of a stainless steel material, which has a rectangular cross section.

In this embodiment, this twisting angle is designed mainly for achieving improvement of the body of the support frame over the prior art and achieving extension of an upper portion of the body of the support frame, such that when the invention is inserted in cups, planes with the two vertical portions twisted coordinate with the shape of the cups, thereby fitting portions abducent from cleavage to breasts to outline a three-dimensional contour of the cleavage. This embodiment is preferably adapted to be used in large cups.

The second embodiment is shown in FIGS. 8, 9, 10, 11 and 12.

In this embodiment, wire surfaces 21, 31 of two vertical portions of the body of the support frame are corresponding twisted outwardly at an angle with respect to a vertical axis, forming an anticlockwise angle of 30° with respect to a vertical plane. The twist starts from a position of the maximum radius of semicircular lower portion of the U shape. The wire surfaces 21, 31 of the two vertical portions are of an arc-shaped structure which is curved outwardly, the outwardly curved portion with a maximum curvature being offset in a distance H of 20 mm with respect to midpoint of the bottom portion of the U-shaped support frame. As can be seen from FIGS. 10, 11 and 12, a plane of the wide flat wire is vertical in the A1-A1 sectional view. With regard to the wires surface of its vertical portions, as seen in the B1 direction, the end surface of the wire surface 2 is at an angle of 30° with respect to the vertical plane. Moreover, since the wire surfaces of two vertical portions of the body of the support frame are correspondingly twisted outwardly at an angle with respect to a vertical axis, as can be seen from FIG. 12, the wire surface of the vertical portion as shown in the C1-C1 sectional position is at an anticlockwise angle of 30° with respect to the vertical plane.

In this embodiment, the wide flat wire forming the body of the support frame is a wire of polyester plastic or a wire of resin plastic. Such materials are of plasticity to ensure wearing comfort.

Other portions of this embodiment are completely the same as those of the first embodiment.

The third embodiment is shown in FIGS. 13, 14, 15, 16 and 17.

Wire surfaces 22, 32 of two vertical portions of the body of the support frame are correspondingly twisted outwardly at an angle with respect to a vertical axis, forming an anticlockwise angle of 60° with respect to a vertical plane. The twist starts from a position of the maximum radius of semicircular lower portion of the U shape. The wire surfaces 22, 32 of the two vertical portions are of an arc-shaped structure which is curved outwardly, the outwardly curved portion with a maximum curvature being offset in a distance H of 40 mm with respect to midpoint of the bottom portion of the U-shaped support frame. As can be seen from FIGS. 15, 16 and 17, a plane of the wide flat wire is vertical in the A2-A2 sectional view. With regard to the wires surface of its vertical portions, as seen in the B2 direction, the end surface of the wire surface 22 is at an angle of 60° with respect to the vertical plane. Moreover, since the wire surfaces of two vertical portions of the body of the support frame are correspondingly twisted outwardly at an angle with respect to a vertical axis, as can be seen from FIG. 17, the wire surface of the vertical portion as shown in the C2-C2 sectional position is at an anticlockwise angle of 60° with respect to the vertical plane.

In this embodiment, the wide flat wire forming the body of the support frame is a silica gel wire or a nylon wire, the cross section of which is an ellipse 4.

Other portions of this embodiment are completely the same as those of the first embodiment.

The fourth embodiment is shown in FIGS. 18, 19, 20, 21 and 22:

In this embodiment, wire surfaces 23, 33 of two vertical portions of the body of the support frame are correspondingly twisted outwardly at an angle with respect to a vertical axis, forming an anticlockwise angle of 85° with respect to a vertical plane. The twist starts at a position of the maximum radius of semicircular lower portion of the U shape. The wire surfaces 23, 33 of two vertical portions are of an arc-shaped structure which is curved outwardly, the outwardly curved portion with a maximum curvature being offset in a distance H of 50 mm with respect to midpoint of the bottom portion of the U-shaped support frame. As can be seen from FIGS. 20, 21 and 22, a plane of the wide flat wire is vertical in the A3-A3 sectional view. With regard to the wires surface of its vertical portions, as seen in the B3 direction, the end surface of the wire surface 23 is at an angle of 85° with respect to the vertical plane. Moreover, since the wire surfaces of two vertical portions of the body of the support frame are correspondingly twisted outwardly at an angle with respect to a vertical axis, as can be seen from FIG. 22, the wire surface of the vertical portion as shown in the C3-C3 sectional position is at an anticlockwise angle of 85° with respect to the vertical plane.

In this embodiment, the wide flat wire forming the body of the support frame is a silica gel wire or a nylon wire, the cross section of which is a trapezoid 5.

Other portions of this embodiment are completely the same as those of the first embodiment.

The invention claimed is:

1. A three-dimensional, heart position, support frame for underwear, comprising a body forming a U-shaped support frame, the body of the support frame being structured as a wide flat wire; wire surfaces of two vertical portions of the body of the support frame being symmetrically twisted outwardly at an angle with respect to a vertical axis, and each forming an anticlockwise angle of 15° -85° with respect to a vertical plane; wherein the lower portion of the U-shaped support frame is a semicircle of constant radius and the twists begin at the position corresponding to the ends of the horizontal diameter of the semicircle; wherein the twisted wire surfaces of the two vertical portions form an arc-shaped structure which is curved outwardly, the outermost portion of the arc being offset by a horizontal distance of 5 mm-50 mm with respect to the midpoint of a bottom portion of the U-shaped support frame.

2. The three-dimensional heart position support frame for underwear according to claim 1, wherein the twisted wire surfaces of the two vertical portions are of an arc-shaped structure which is curved outwardly, the outwardly curved portion with a maximum radian thereof being offset in a distance of 5 mm with respect to the midpoint of the bottom portion of the U-shaped support frame; and that the wire surfaces of the two vertical portions are at an anticlockwise angle of 15° with respect to the vertical plane.

3. The three-dimensional heart position support frame for underwear according to claim 1, wherein the twisted wire surfaces of the two vertical portions are of an arc-shaped structure which is curved outwardly, the outwardly curved portion with a maximum radian thereof being offset in a distance of 20 mm with respect to the midpoint of the bottom portion of the U-shaped support frame; and that the wire surfaces of the two vertical portions are at an anticlockwise angle of 30° with respect to the vertical plane.

4. The three-dimensional heart position support frame for underwear according to claim 1, wherein the twisted wire surfaces of the two vertical portions are of an arc-shaped structure which is curved outwardly, the outwardly curved portion with a maximum radian thereof being offset in a distance of 40 mm with respect to the midpoint of the bottom portion of the U-shaped support frame; and that the wire surfaces of the two vertical portions are at an anticlockwise angle of 60° with respect to the vertical plane.

5. The three-dimensional heart position support frame for underwear according to claim 1, wherein the twisted wire surfaces of the two vertical portions are of an arc-shaped structure which is curved outwardly, the outwardly curved portion with a maximum radian thereof being offset in a distance of 50 mm with respect to the midpoint of the bottom portion of the U-shaped support frame; and that the wire surfaces of the two vertical portions are at an anticlockwise angle of 85° with respect to the vertical plane.

6. The three-dimensional heart position support frame for underwear according to claim 1, wherein the wide flat wire forming the body of the support frame is of a stainless steel material.

7. The three-dimensional heart position support frame for underwear according to claim 1, wherein the wide flat wire forming the body of the support frame is a wire of polyester plastic or a wire of resin plastic.

8. The three-dimensional heart position support frame for underwear according to claim 1, wherein the wide flat wire forming the body of the support frame is a silica gel wire or a nylon wire.

9. The three-dimensional heart position support frame for underwear according to claim 1, wherein the wide flat wire has a cross section of an ellipse.

10. The three-dimensional heart position support frame for underwear according to claim 1, wherein the wide flat wire has a cross section of a trapezoid.

* * * * *